US005819965A

United States Patent [19]

King et al.

[11] Patent Number: 5,819,965

[45] Date of Patent: Oct. 13, 1998

[54] TAMPER EVIDENT RING FOR A CONTAINER CLOSURE

[75] Inventors: Witney Milner King; Roger Milner King, both of Latimer Bucks, United Kingdom

[73] Assignee: Beeson and Sons Limited, Rickmansworth Herts, England

[21] Appl. No.: 915,541

[22] Filed: Aug. 13, 1997

Related U.S. Application Data

[63] Continuation of Ser. No. 436,338, Jul. 31, 1995, abandoned.

[30] Foreign Application Priority Data

Nov. 13, 1992 [GB] United Kingdom ..... 9223779
Dec. 17, 1992 [GB] United Kingdom ..... 9226320

[51] Int. Cl.[6] ..... B65D 41/34
[52] U.S. Cl. ..... 215/252
[58] Field of Search ..... 215/252

[56] References Cited

U.S. PATENT DOCUMENTS

D. 327,644 7/1992 Offley et al. .
D. 329,980 10/1992 Powell et al. .
D. 364,808 12/1995 King .
D. 381,907 8/1997 King .

(List continued on next page.)

FOREIGN PATENT DOCUMENTS 0 117 948 9/1984 European Pat. Off. .
0 146 237 6/1985 European Pat. Off. .
0 154 611 9/1985 European Pat. Off. .
0 330 964 9/1989 European Pat. Off. .
724431 4/1932 France .
2036272 12/1970 France .
2 411 770 7/1979 France .
2 439 140 5/1980 France .
2 558 443 7/1985 France .
2 564 803 11/1985 France .
2 572 369 5/1986 France .
36 05 963 8/1987 Germany .
1 438 648 6/1976 United Kingdom .
1 438 885 6/1976 United Kingdom .
2 134 873 8/1984 United Kingdom .
2 203 729 10/1988 United Kingdom ..... B65D 41/04
2 223 748 4/1990 United Kingdom .
2 260 534 4/1993 United Kingdom .
2 261 656 5/1993 United Kingdom .
2 262 280 6/1993 United Kingdom .
2 264 108 8/1993 United Kingdom .
2 267 076 11/1993 United Kingdom .
2 267 082 11/1993 United Kingdom .
2 267 484 12/1993 United Kingdom .
WO 91/01924 2/1991 WIPO .
WO 93/01098 1/1993 WIPO .
WO 94/11267 5/1994 WIPO .

*Primary Examiner*—Stephen Cronin
*Attorney, Agent, or Firm*—Brinks Hofer Gilson & Lione

[57] ABSTRACT

A container closure assembly including a container neck having a first screw thread, a radially projecting bead located below the first screw thread, and one or more ratchet projections located below the radially projecting bead. The container closure further includes a closure having a skirt portion with a second screw thread complementary to the first screw thread for securing the closure on the container neck. A tamper evident ring is joined to the skirt portion by severable connections and includes a generally annular collar for the neck, an opening or recess formed in the collar, wherein a portion of an edge of the opening or recess is attached to a tab. The tab is inclined radially inwardly and obliquely relative to a central axis of the ring and flexes relative to the collar in a radially outward direction. The ratchet projections allow rotation of the tamper evident ring in a screwing direction on the neck, but block rotation of the tamper evident ring in an unscrewing direction by abutment with the tab, whereby, when the closure is initially screwed onto the container neck, the tab flexes outwardly to allow the tamper evident ring to pass over the bead, and then rotates past the ratchet projections as the tamper evident ring is rotated in the screwing down direction. When the closure is unscrewed from the container neck for the first time, the tab abuts against an underside of the bead and also against the ratchet projections to exert axial and circumferential breaking forces on the tamper evident ring.

40 Claims, 5 Drawing Sheets

U.S. PATENT DOCUMENTS

| | | | |
|---|---|---|---|
| 3,347,403 | 10/1967 | Lehrman . | |
| 3,737,064 | 6/1973 | Patel et al. . | |
| 3,924,769 | 12/1975 | Fillmore . | |
| 3,944,102 | 3/1976 | Grau . | |
| 4,147,268 | 4/1979 | Patel et al. . | |
| 4,157,144 | 6/1979 | Weiler et al. . | |
| 4,289,248 | 9/1981 | Lynn . | |
| 4,335,824 | 6/1982 | Bush . | |
| 4,387,822 | 6/1983 | Lynn . | |
| 4,469,235 | 9/1984 | Parker . | |
| 4,493,427 | 1/1985 | Wolkonsky . | |
| 4,527,701 | 7/1985 | Schaubeck . | |
| 4,562,931 | 1/1986 | Brach et al. . | |
| 4,592,476 | 6/1986 | Yasada . | |
| 4,658,977 | 4/1987 | Crisci . | |
| 4,731,512 | 3/1988 | Barriac . | |
| 4,746,026 | 5/1988 | Leonhardt . | |
| 4,756,438 | 7/1988 | Ryder | 215/252 |
| 4,770,308 | 9/1988 | Lynn . | |
| 4,828,127 | 5/1989 | Young et al. | 215/252 |
| 5,103,991 | 4/1992 | Collins . | |
| 5,213,225 | 5/1993 | King et al. . | |
| 5,219,084 | 6/1993 | King . | |
| 5,346,082 | 9/1994 | Ochs et al. | 215/252 |
| 5,356,020 | 10/1994 | Thompson | 215/252 |
| 5,411,157 | 5/1995 | King et al. . | |
| 5,454,476 | 10/1995 | King et al. . | |
| 5,533,633 | 7/1996 | King . | |
| 5,588,545 | 12/1996 | King . | |
| 5,590,799 | 1/1997 | King . | |
| 5,611,443 | 3/1997 | King . | |
| 5,638,969 | 6/1997 | King . | |
| 5,667,088 | 9/1997 | King et al. . | |
| 5,676,268 | 10/1997 | King . | |

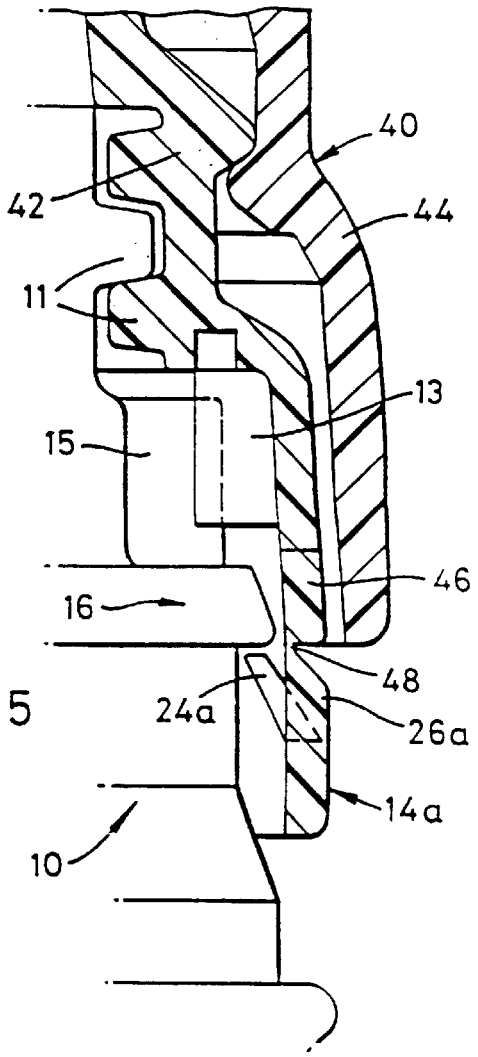
FIG. 5
FIG. 4
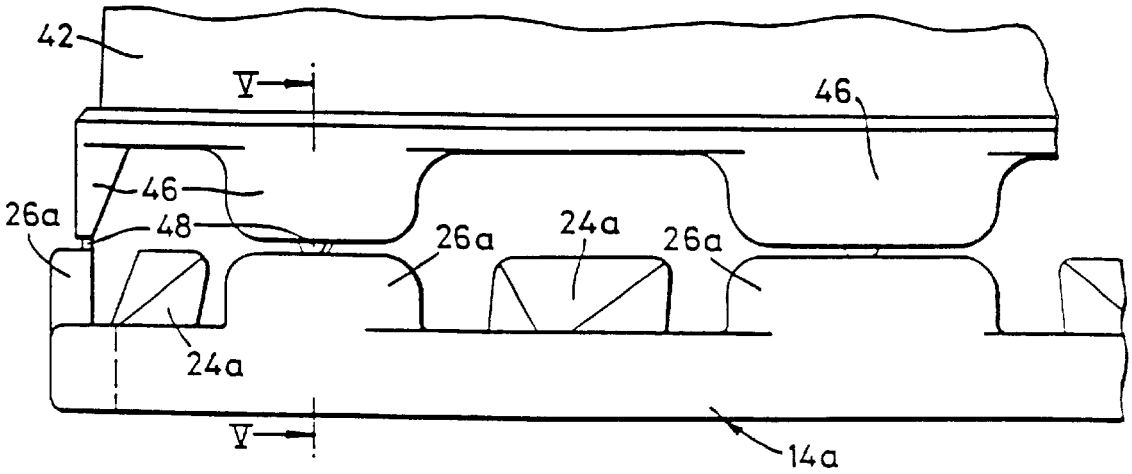

TAMPER EVIDENT RING FOR A CONTAINER CLOSURE

This application is a continuation of application Ser. No. 08/436,338, filed Jul. 31, 1995 now abandoned.

BACKGROUND OF THE INVENTION

1. Field of the Invention

This invention relates to a tamper evident ring for a container closure. In particular it relates to a ring which is intended to be retained on a container neck when the container closure has been removed.

2. Description of the Related Art

A known design of tamper evident ring includes a plurality of severable connections initially joining the ring to the container closure, and a plurality of solid radial ramp projections to engage behind a rim of the neck. When the closure is removed for the first time, the projections abut the rim to retain the ring on the neck, thus causing the ring to become severed from the closure. The ramp shape of the projections is intended to allow the ring to be fitted easily on to the rim, but not easily removed.

However, a problem with this design is achieving reliability in use. Typically, this sort of ring might be about 80% reliable. If the projections are too small, the ring will be not retained securely on the neck, and it might remain intact with, or at least partly intact with, the closure when the closure is removed for the first time. Besides it being inconvenient for a user to have to separate the ring from the closure manually once the closure has been removed, this also means that the ring cannot give a guaranteed tamper-proof indication.

On the other hand, if the projections are large to ensure that the ring will be retained reliably on the neck, it can then be difficult to fit the ring initially on the neck without risking damage to some of the severable connections. When the ring is fitted, it will have to expand temporarily to enable the projections to pass over the rim, and excessive stress in the severable connections caused by the expansion can lead to premature breaking.

The present invention has been devised with the above problems in mind, and with the particular aim of providing an improved design of tamper evident ring.

SUMMARY OF THE INVENTION

In a first aspect the invention provides a tamper evident ring for a container closure assembly including a container neck with a rim and a container closure therefor, the tamper evident ring comprising a collar for the neck and a plurality of tabs extending from the collar, the tabs being inclined radially inwardly and obliquely relative to the central axis of the ring in use to engage the rim of the neck in order to retain the ring thereon, the tabs being resiliently flexible in a radially outward direction and relative to the collar from which they extend to enable the tabs to flex outwardly without substantial expansion of the collar when the tamper evident ring is fitted initially over the rim of the neck.

With this form of ring, the collar does not need to expand substantially when the ring is fitted to the container neck, and this results in reduced frictional forces between the tamper evident ring and the rim, and reduced stresses in any releasable connections to the closure. Once the tabs have passed over the rim of the container neck, they can locate securely behind or under the rim, thereby ensuring that the ring is retained reliably on the neck when the closure is removed for the first time.

It is to be understood that the term "rim" or "bead" used herein includes any sort of radial flange extending around the container neck. The rim or bead may be located at the open end of the neck or it may be spaced from the open end.

Preferably, the ring comprises a plurality of tabs angularly spaced from one another, and being capable of flexing outwardly independently of one another. The number of tabs may, for example, be between 2 and 8, although more tabs could be provided as desired. The number may depend on the application for which the ring is intended, and specifically the diameter of the container neck.

Preferably, each tab is capable of flexing resiliently along its length (ie. from its end joined to the collar to the remote end). This can ensure that when the ring is fitted over the rim of the container neck, each tab will spring back into a position in which it will securely engage the rear edge of the rim.

To improve the resilience, each tab may be tapered towards its free end. In one embodiment, each tab is thinned towards its free end to form a resiliently flexible leaf or blade.

In addition to being resilient, or as an alternative, one or more of the tabs may be supported at its fixed end by a hinge. The hinge may be integral with the tab and take the form of pliant material.

In the preferred embodiment, the tabs are integral with the tamper evident ring and are made of resiliently deformable or pliant material, such as plastics. The tabs are capable of flexing both by their resilience, and by the "hinge" effect at the join with the tamper evident ring.

In one form, the tamper evident ring is sized so that the collar can fit easily over the rim of a container neck without direct contact therewith, the tabs being inclined to project radially inwardly from the collar to resiliently engage behind the rim of the container neck.

The tamper evident ring may be coupled to the closure by severable connections which are designed to break easily when the closure is removed from the container neck for the first time.

In one form, the tamper evident ring may comprise a plurality of angularly spaced first and second portions, the first portions defining a plurality of tabs as aforesaid, the second portions defining regions which are joined to a closure by severable connections, and the first and second regions being separated from one another by slots or gaps which extend at least partially through the tamper evident ring. The first and second portions may be arranged alternately on the tamper evident ring, but other configurations could also be used.

With this arrangement, the portions defining the tabs can flex somewhat independently of the other portions which are connected to the closure. In this way, the flexing of the tabs when the ring is fitted over the rim of the neck will not risk damaging the severable connections.

In the preferred embodiment, the slots extend through the ring in a radial direction, but not all the way through in an axial direction.

The tamper evident ring of the invention may be used with child-resistant or non-child-resistant closures. The ring may be exposed so that it is intended to be visible for inspection at all times. Alternatively, the ring may be arranged to be concealed from view within a skirt of the closure, until the closure is removed from the container neck for the first time.

In a second aspect, the invention provides a tamper evident ring for a container assembly including a container neck with a rim and a container closure therefor, the tamper evident ring comprising a collar for the neck and a plurality of tabs extending from the collar, the tabs being inclined radially inwardly and obliquely to the central axis of the ring in use to engage the rim of the neck in order to retain the ring thereon, the tabs being spaced apart angularly and one or more gaps or slots being formed between neighbouring tabs to permit the tabs to be resiliently flexible independently of one another in a radially outward direction, so that the tabs can flex outwardly when the tamper evident ring is fitted initially over the rim on the neck.

With this arrangement, the gaps permit the tabs to flex outwardly independently of each other. Thus the ring can be easier to fit over the rim than some conventional designs in which corresponding "hook" projections are supported on the inner face of a common cylindrical web or wall.

In a third aspect, the invention provides a tamper evident ring for a container closure assembly including a container neck with a rim and a container closure therefor, the tamper evident ring comprising a plurality of angularly spaced first and second portions, the first portions defining a plurality of tabs inclined radially inwardly and obliquely relative to the central axis of the ring, the second portions defining regions for joining to a said closure by releasable connections, the first portions being resiliently flexible in a radially outwardly direction, and adjacent ones of the first and second portions being separated by gaps to permit the first portions to flex radially outwardly independently of the second portions.

With this arrangement, when the ring is fitted initially on to the neck and over the rim, the tabs defined by the first portions will be able to flex somewhat independently of the second portions. This results in reduced frictional forces between the tamper evident ring and the rim of the neck, and reduced stresses in the releasable connections to the closure. Thus the risk of damage to the releasable connections during the initial fitting can be much reduced.

In a fourth aspect, the invention provides a tamper evident ring for a container closure assembly including a container neck with a rim and a container closure therefor, the tamper evident ring comprising a generally annular collar for the neck, a plurality of tabs extending from the collar, the tabs being inclined radially inwardly and obliquely relative to the central axis of the ring in use to engage the rim of the neck in order to retain the ring thereon, and a plurality of openings or recesses in the collar, at least one for each tab, each opening or recess defining a clearance in the collar to permit the respective tab to flex relative to the collar in a radially outward direction when the tamper evident ring is fitted initially over the rim of the neck.

In one embodiment, the collar comprises circumferential openings through the wall of the collar, one for each tab. The openings define a clearance around the tab, except at the end of the tab which is joined to the annular collar. The collar may have the form of two annular "beads" spaced from one another by a plurality of integrally formed, angularly spaced, arcuate sections. The tabs extend from one of these "beads" at angular positions between adjacent arcuate sections and the gaps between the arcuate sections define the openings around the tabs.

With such a design, the tamper evident ring can have a generally cylindrical external profile, and be generally smooth on its upper edge. Such a form is desirable so as to avoid external projections on which a person might accidentally scratch his or her hand while fitting or removing the closure in later use.

As explained above in relation to the first aspect of the invention, the tabs are preferably resiliently deformable along their lengths. Additionally or alternatively, the tabs may be joined by pliant "hinge" material to the remainder of the ring.

In a further aspect, the invention provides an assembly comprising a container neck with a rim, a container closure threadably securable on the neck, and a tamper evident ring joined to the closure by severable connections, the ring comprising a plurality of tabs projecting inwardly and inclined upwardly towards the open end of the neck, the tabs locating against the rim to retain the ring on the neck and the tabs being outwardly flexible relative to the ring to permit the ring to be fitted initially over the rim, the assembly further comprising means for restricting rotation of the ring relative to the neck such that an at least partially torsional force is applied to the severable connections when the closure is removed for the first time.

With this arrangement, the severable connections can be subjected to both a torsional shearing force and an axial strain to ensure reliable shearing when the closure is removed for the first time. Furthermore, the flexible tabs are not subjected to as much axial force as they would if the assembly relied only on axial strain to severe the severable connections.

Preferably, the means for restricting rotation restricts rotation of the ring when the closure is rotated in one sense to unscrew it from the container neck, but it does not substantially restrict rotation of the ring when the closure is rotated in the opposite sense to secure the closure initially on the neck. Such an arrangement avoids substantial torsional forces being applied to the severable connections when the closure is being secured to the neck, which forces might otherwise risk damage to the severable connections.

Preferably the means for restricting comprises co-operating projections on the ring and on the neck. Preferably, the projections co-operate as a ratchet to restrict rotation in one sense, but to permit rotation in the opposite sense.

Preferably, at least one of the projections comprises a ramp profile, having a circumferentially or arcuately extending ramp surface, and an abutment surface.

Preferably, a projection is located on the neck at an axial position which is further from the open end of the neck than is the rim. In one form, the projection may be in contact with, or joined to, the rim. In the preferred embodiment, the projection comprises a "stop" extending axially from under the rim (as seen when the container is upright) and integrally joined thereto.

The corresponding projection on the ring may conveniently comprise one or more of the tabs which engage the rim. Thus the tab or tabs will have a dual role. Firstly they can co-operate axially with the rim to retain the ring on the neck, and secondly they can co-operate rotationally or circumferentially with the neck stop projection to restrict rotation of the ring.

More than one neck stop may be provided. The stops can be angularly spaced so that they will engage respective ones of the tabs when a person begins to unscrew the closure for the first time. The number of neck stops may, for example, equal the number of tabs on the ring.

Preferably, the assembly further comprises a locking mechanism for defining, and for positively retaining the closure in, a predetermined closed orientation on the neck. When in the predetermined closed position, the tabs are preferably arranged so that they are in appropriate predetermined positions with respect to the stops on the necks. For example, the tabs may be positioned near or adjacent respective stops, so that when a person begins to unscrew the closure for the first time, the tabs abut the stops after only limited rotation of the closure to thereby restrict further rotation of the ring, and apply torsional stress to the severable connections.

In a yet further aspect, the invention provides an assembly comprising a container neck with a rim, a container closure threadably securable on the neck, and a tamper evident ring joined to the closure by severable connections, the ring comprising a plurality of inwardly projecting claws which in use locate against the rim axially to retain the ring on the neck, the assembly further comprising means on the neck for co-operating with a respective one or ones of the claws for restricting rotation of the ring relative to the neck such that an at least partially torsional force is applied to the severable connections when the closure is removed for the first time.

Preferably the means on the neck co-operates with respective ones of the claws to form a rotational ratchet which restricts rotation of the ring when the closure is rotated in one sense to unscrew it from the neck, but it does not substantially restrict rotation of the ring when the closure is rotated in the opposite sense to secure the closure initially on the neck.

In a further aspect, the invention provides a closure assembly comprising a container closure with a tamper evident ring having one or more features as aforesaid.

In a yet further aspect, the invention provides a container closure assembly comprising a container neck, a container closure, and a tamper evident ring having one or more features as aforesaid.

Preferably, the assembly includes means for positively retaining the closure in a closed orientation on the neck. Such means may comprise mutually engageable locking elements on the neck and on the closure.

Preferably, the closure is securable on, or is removable from, the neck by relative rotation of about 360° or less. More preferably this angle is about 180° or less, and most preferably, the angle is about 90° or less.

Embodiments of the invention are now described by way of example, with reference to the accompanying drawings, in which:

BRIEF DESRIPTION OF THE DRAWINGS

FIG. 4 is a similar view to FIG. 2 but showing a modified form of ring;

FIG. 5 is a sectional view showing the ring of FIG. 1 installed on a child-resistant container closure assembly;

DESCRIPTION OF THE PREFERRED EMBODIMENT

Figure 1:
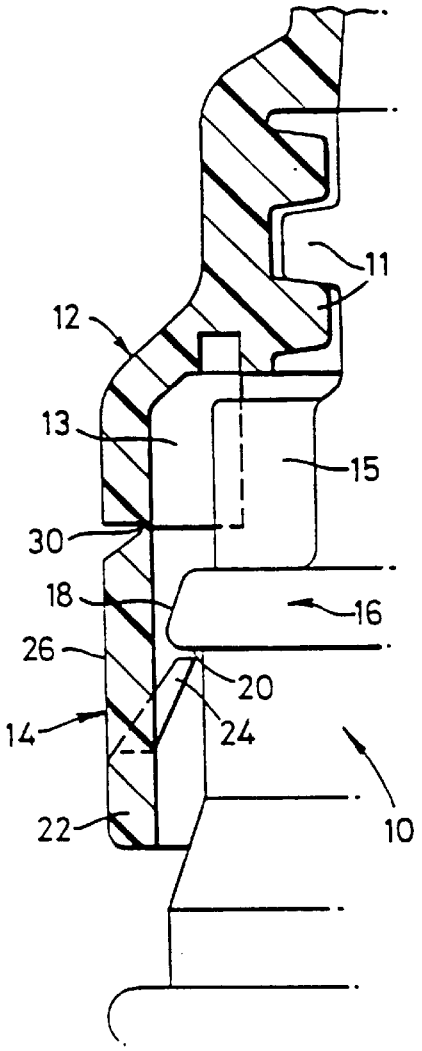
FIG. 1 is a sectional view showing a tamper evident ring installed in a container closure assembly.
Figure 2:
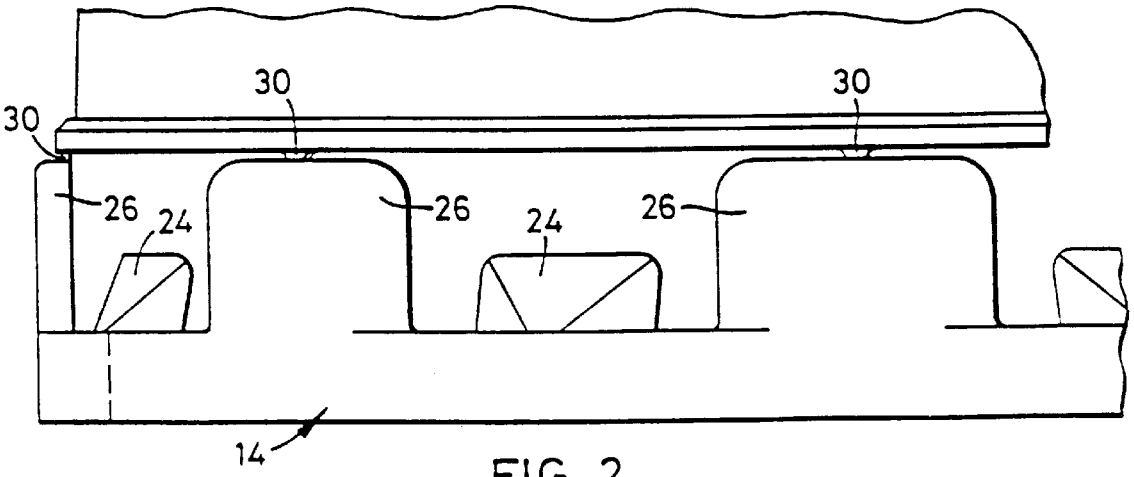
FIG. 2 is a side view of a portion of the assembly of FIG. 1.
Figure 3:
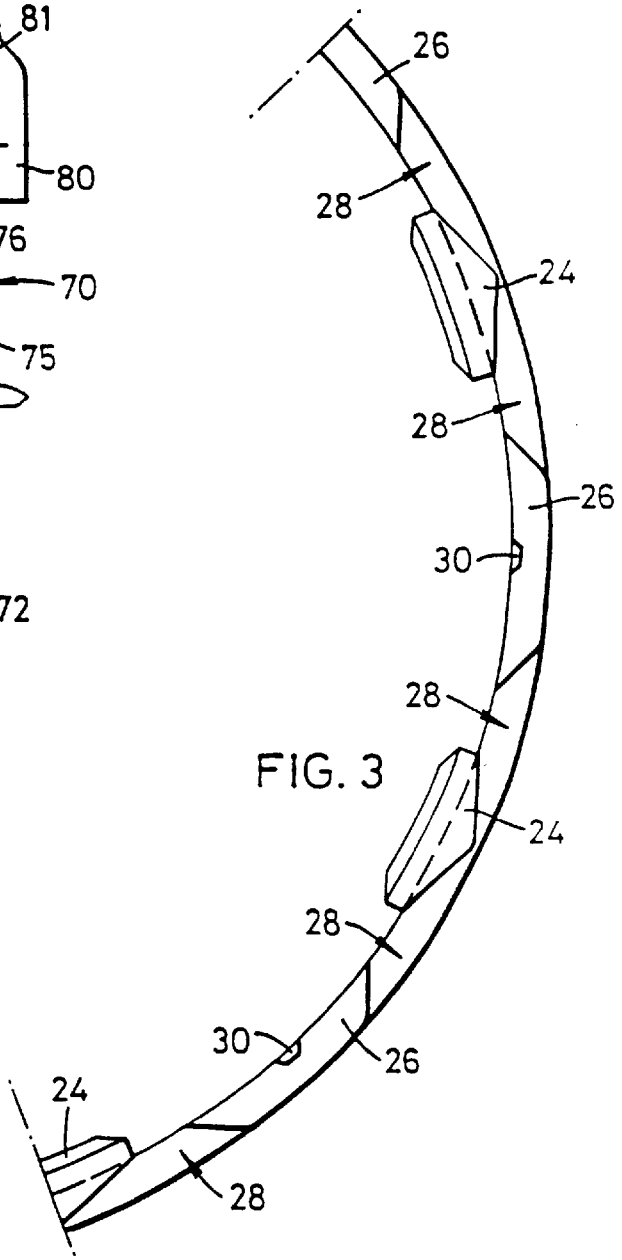
FIG. 3 is a plan view showing a portion of the tamper evident ring of FIG. 1 in isolation.

Referring to FIGS. 1–3, a container closure assembly comprises a screw threaded container neck 10, a screw threaded closure 12 adapted to fit on to the neck, and a tamper evident ring 14. The neck 10 is formed with a radially projecting rim 16 below the open end of the neck. The rim 16 has an upwardly inclined ramp surface 18 and a rear abutment surface 20.

The closure 12 and the neck 10 carry engageable screw threads 11 to permit the closure 12 to be secured to, or unscrewed from, the neck 10 by relative rotation through about a quarter of a turn (ie. about 90°). The closure 12 carries a locking rib 13 for engagement with a stop formation 15 formed on the neck 10. The rib 13 and the stop formation 15 together provide a positive locking effect for positively retaining the closure 12 in a fully closed orientation on the neck 10, until a person applies a predetermined release torque in the unscrewing direction to disengage the rib 13 and the stop formation 15.

The tamper evident ring 14 comprises a generally solid annular collar portion 22 from which extend a plurality of first portions in the form of fingers (or tabs) 24, and a plurality of second portions in the form of axial castellations 26. The castellations 26 and the fingers 24 are arranged alternately at angularly spaced positions around the collar portion 22. The fingers 24 are each inclined upwardly and radially inwardly, and taper towards their free ends. Adjacent fingers 24 and castellations 26 are separated by gaps 28 which extend axially part way into the ring, and radially all the way through the ring.

The number of fingers 24 may typically be between 2 and 8, but more fingers could be used if desired. The present embodiment uses eight fingers 24, and these are equally angularly spaced around the collar portion 22.

The tamper evident ring 14 is joined to the lower edge of the closure 12 by a plurality of thin severable bridges, or connections 30, each extending between a respective castellation 26 and a corresponding castellation or projection 32 arranged in register on the lower edge of the closure 12. The axial height of the castellations 26 on the ring 14 is roughly the same as the fingers 24.

The ring 14 is integrally formed of moulded plastics. The inner diameter of the collar portion 22 is large enough to enable the collar portion 22 to fit over the rim 16 substantially without direct contact therewith. However, the diameter of the pitch circle defined by the free ends of the fingers 24 is smaller than the outer diameter of the rim 16, so that the fingers 24 will engage the rim 16.

The fingers 24 are designed so that they are capable of flexing radially outwardly. When the closure 12 is fitted to the neck 10 for the first time, the fingers 24 engage against the ramp surface 18 of the rim, and the fingers 24 flex outwardly to pass over the rim. The tapered profile of each finger 24 allows the finger to flex more towards its free end. The resilience of the plastics material ensures that the finger will be able to accommodate the flexing and spring back to its inwardly inclined position once the finger has passed over the rim 16. There is also a "hinge" effect provided by the plastics material at the point where each finger 24 is joined to the collar portion 22 of the ring 14.

The above design ensures that the fingers 24 are able to flex outwardly independently of the castellations 26, and without causing substantial expansion of the collar portion 22. Thus when the closure 12 is fitted to the container neck 10 for the first time to engage the ring 14 on to the neck 10, the frictional forces produced between the ring 14 and the rim 16, are much reduced compared to some conventional designs. Consequently, the severable connections 30 are subjected to less stress, and the risk of damage to the severable connections 30 is reduced.

Once the ring 14 has been fitted over the rim 16, the fingers 24 will spring back to their inclined position to engage behind the rim 16. When the closure 12 is removed for the first time, the ends of the fingers 24 will engage against the abutment surface 20 of the rim 16 to retain the ring 14 securely on to the neck 10. The severable connections 30 will be torn apart as the closure 12 moves away from the ring 14 retained on the neck.

It may be found prudent when fitting the closure 12 with the ring 14 to the neck 10 for the first time to provide some means for applying rotational and axially downward pressure directly on to the ring 14 rather than relying on merely the severable connections 30 to provide this pressure from the closure. However, the arrangement of the fingers 24 still relieves the frictional forces occurring between the ring 14 and the rim 16, thereby providing an easier fit.

FIG. 4 shows a slightly modified form of tamper evident ring 14*a* in which the size of the castellations 26*a* on the ring is increased relative to the size of the fingers 24*a*. The castellations on the closure are omitted, and the severable connections 30*a* connect directly to a lower edge of the closure. The functional design of the ring 14*a* is the same as that for the ring 14 described above.

FIG. 5 shows the tamper evident ring 14 installed on a child resistant closure 40. The closure 40 comprises an inner part 42, and an axially displaceable outer part 44 which are coupled together by a child resistant mechanism (not shown). The ring 14 is coupled by severable connections 46 to the inner part 42. As shown in FIG. 5, the outer part 44 does not extend downwardly to cover the tamper evident ring 14 when the outer part 44 is not being depressed. This allows a person to inspect the severably connections 46 to ascertain whether they are intact.

Figure 7:
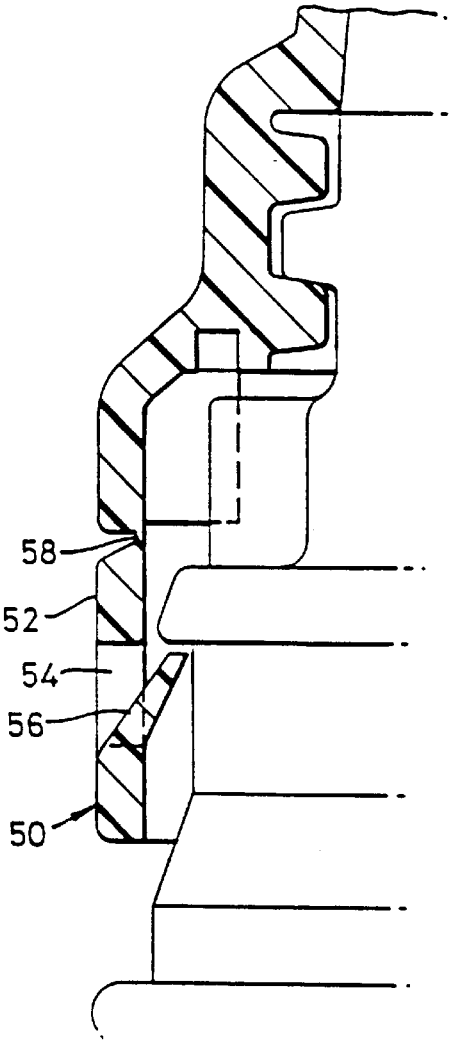
FIG. 7 is a sectional view along the line VII—VII of FIG. 6 but showing the closure fitted to a container neck.
Figure 6:
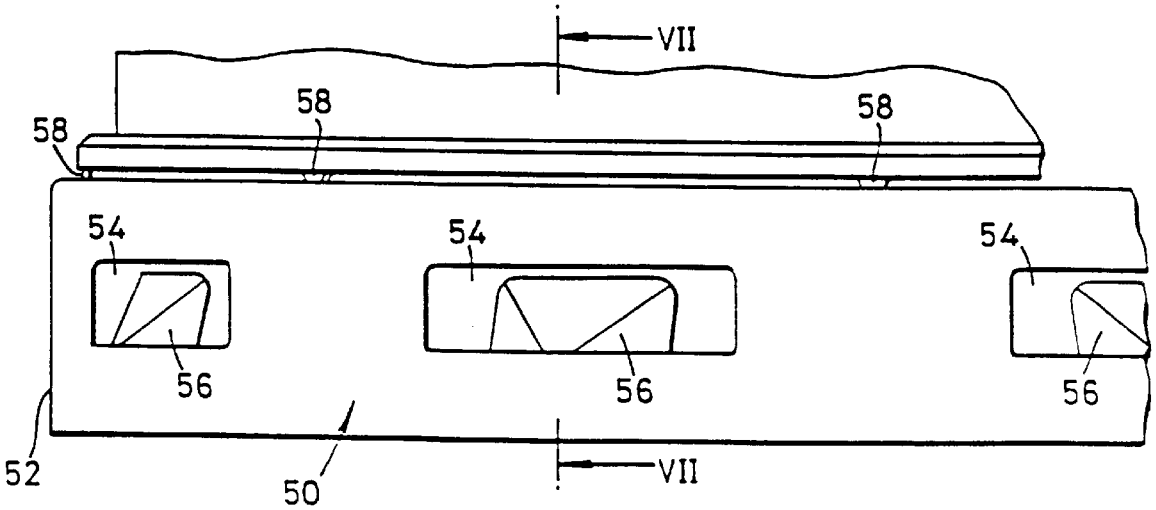
FIG. 6 is a view similar to FIG. 2 but showing a further modified form of ring.

FIGS. 6 and 7 show a further modified form of tamper evident ring 50. The ring is integrally formed of moulded plastics, as in the previous embodiments, but the castellations of previous embodiments are replaced by a generally cylindrical wall 52 with circumferential openings around the tabs 56. The openings 54 each provide a clearance above and on either side of a respective tab 56 to permit the tab 56 to flex radially outwardly without being obstructed by the cylindrical wall 52. Thus the tabs are able to "hinge" and bend resiliently without stressing the cylindrical wall 52, and without risking damage to the severable connections 58 which join the upper edge of the rim 50 to the lower edge of the closure.

Figure 8:
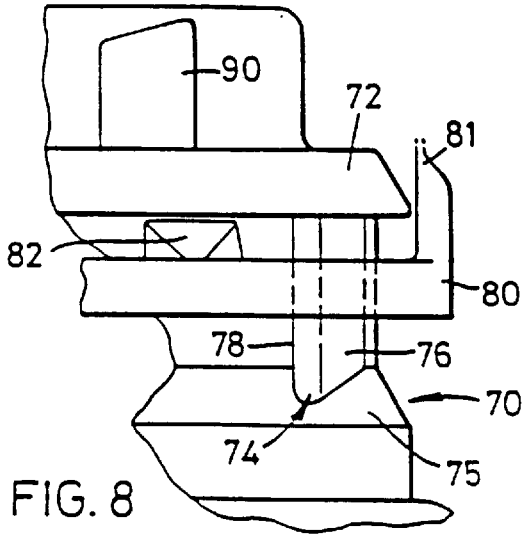
FIG. 8 is a partial side view showing a container neck and tamper evident ring of a further embodiment (in isolation from the closure)
Figure 9:
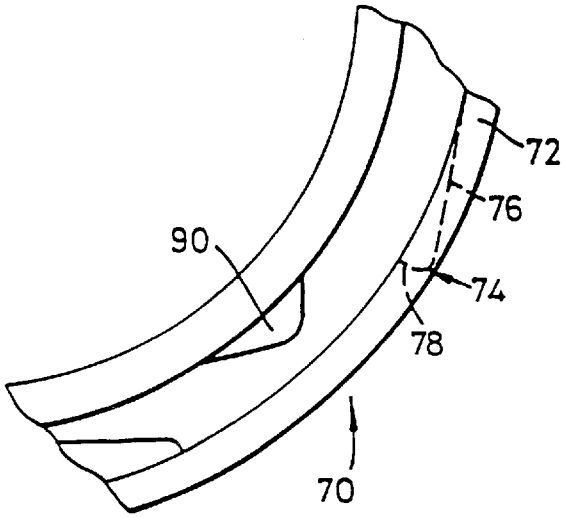
FIG. 9 is a partial section from above illustrating how the ring co-operates with the container neck of FIG. 8.

The design of the neck in FIG. 8 is similar to that in the embodiments shown in FIGS. 1–7. The neck 70 includes a rim 72 which has the same shape as the rim 16 shown in FIGS. 1–7. Axially below the rim 72 are formed two stop formations 74 at diametrically opposed angular positions. Only one stop formation is shown in FIGS. 8 and 9.

Each stop formation 74 has a circumferential ramp surface 76 and a substantially radial abutment surface 78. At its radially outermost portion, the stop formation is about flush with the radially outermost portion of the rim 72. In this embodiment, the end profile of the abutment surface 78 is substantially rectangular.

The tamper evident ring 80 is similar to the designs shown in FIGS. 1–7 in that it includes a plurality of flexible blades or tabs 82. When the closure is being screwed on (e.g. clockwise) for the first time, the tabs 82 bear against the rim 72 and flex radially outwardly relative to the collar of the ring 80 to permit the ring 80 to be fitted easily over the rim 72.

The tabs 82 also co-operate with the stop formations 74 to form a rotational ratchet. On clockwise rotation (i.e the screwing-on direction), respective ones of the tabs 82 will bear against the ramp surfaces 76 of the stop formations 74. The tabs 82 can flex radially outwardly to ride easily over the ramp surfaces 76. Thus, during initial screwing on of the closure, the stop formations 74 do not restrict rotational movement of the ring, and the severable connections are not stressed.

On anti-clockwise rotation (i.e. the unscrewing direction), respective ones of the tabs 82 will bear against the abutment surfaces 78 of the stop formations 74. The abutment surfaces 78 act as stops to prevent further rotation of the ring 80 in that direction relative to the neck. Thus when the closure is unscrewed for the first time, the ring 80 will initially move with the closure until further rotation of the ring 80 relative to the neck is prevented by the stop formations 74. Thereafter, continued unscrewing of the closure will cause a torsional stress to be applied to the severable connections to cause the connections to shear.

At the same time as torsional stress is being applied to the severable connections, the tabs 82 will also engage against the lower surface of the rim 72 as the closure moves up the thread on the neck 70. Therefore an axial stretching force will also be applied to the severable connections, as described in the embodiments shown in FIGS. 1–7.

By the use of both a torsional shearing force and an axial shearing force, more positive and predictable shearing of the severable connections can be achieved. This is particularly important when the closure is movable through only about 90 degrees (or less) between its closed and opened positions, such as the closure systems described in our International Patent Applications Nos. PCT/GB91/00850 and PCT/GB92/01255.

It will be appreciated that in this embodiment, the tabs 82 have a dual role. Firstly they serve to engage the rim 72 to retain the ring 80 axially on the neck 70. Secondly they serve to engage the stop formations 74 to restrict rotation of the ring 80 relative to the neck 70.

It will also be appreciated that by suitable design of the neck 70, ring 80 and the closure, it is possible to control the relative amounts of torsional stress and axial stress which will be applied to the severable connections when the closure is removed for the first time. For example, this will depend on the orientation of the closure when the stop formations 74 are rotationally engaged, and the orientation when the rim 72 is axially engaged. In some embodiments it may be desirable to have the axial and torsional stresses occurring simultaneously. In other embodiments it may be desirable to have, for example, the torsional stress applied first, followed (upon further rotation of the closure) by the axial stress.

The present exemplary embodiment also includes a locking device to positively define a closed orientation of the closure on the neck, and to positively retain the closure in its closed position until a predetermined release torque is applied. The locking device comprises a locking formation 90 on the neck 70 above the rim 72 for co-operating with a corresponding rib (not shown) in the closure. When the closure is in the predetermined closed orientation on the neck, the tabs 82 are arranged with respect to the two stop formations such that engagement of respective ones of the tabs 82 with the stop formations 74 will occur with only a small amount of anti-clockwise rotation being required.

Figure 10:
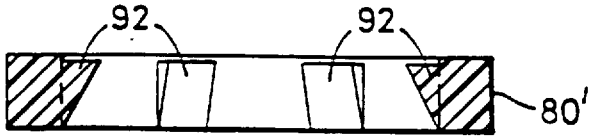
FIG. 10 shows a modified embodiment of the tamper evident ring.

FIG. 10 shows a modification to the tamper evident ring 80 for use with the stop formations 74. In FIG. 10, the tabs 82 are replaced by fixed hook or claw projections 92 which project radially inwardly from the ring. The projections 92 perform the same axial retention/rotation restriction role as the tabs 82 described above.

Figure 11:
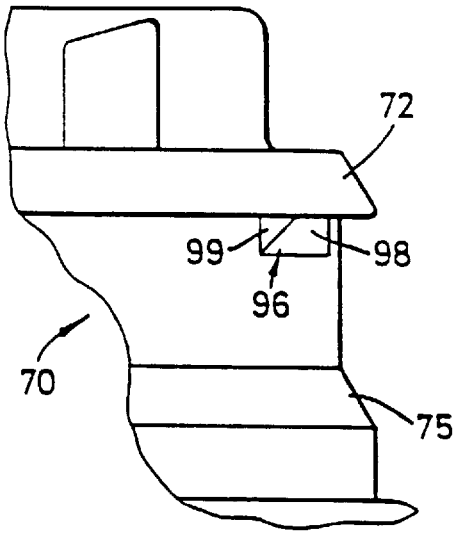
FIG. 11 shows a modified neck arrangement.
Figure 12:
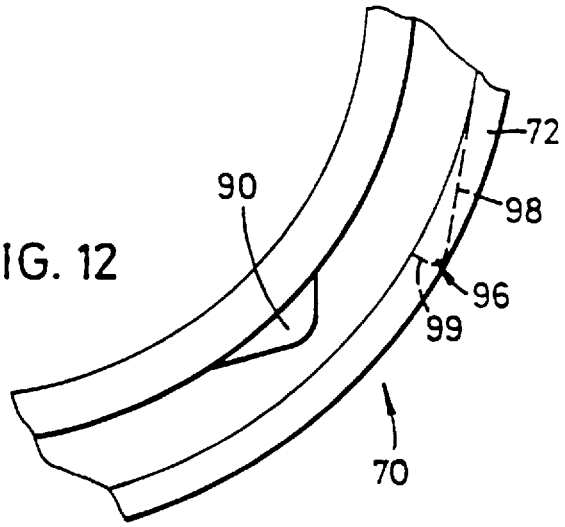
FIG. 12 is a partial sectional view from above of the neck illustrated in FIG. 11.

FIGS. 11 and 12 shows a modification of the stop formations on the neck 70. In these figures, the stop formation 96 is chamfered radially inwardly as they extend axially below the rim 72. The axial length of the formation 96 is less than that of the formation 74 described above. The formation has a respective circumferential ramp surface 98 similar to the ramp surface 76 described above, and a triangular shaped abutment surface 99 similar to the abutment surface 78 described above. It will be appreciated that other designs of stop formation could also be used.

The number of stop formations on the neck may depend on the application for which the tamper evident ring is intended. For the present embodiment two stops have been found to be sufficient, and give good stability in diagonally opposed positions. However, other embodiments might use a lesser number (e.g. one) or a greater number (e.g. four, six, or eight) of stop formations.

In a further alternative embodiment (not shown in the drawings), a skirt could be provided on the closure to substantially conceal the ring from view when intact with the closure. Once severed from the closure, the ring would drop down the neck to a lower position in which it would no longer be concealed when the closure was replaced on the neck.

The tamper evident ring of the present invention may be used with many different designs of container closure assembly. It is, however, particularly suitable for use with the arrangements described in our International patent applications Nos. PCT/GB91/00850 (published as WO 91/18799), whose disclosure in present in U.S. Pat. Nos. 5,213,225 and 5,454,476, and PCT/GB'92/01255(published as WO 93/01098), whose disclosure correspond to U.S. patent application Ser. No. 07/956,039, now abandoned and U.S. Pat. No. 5,411,157. The contents of U.S. patent application Ser. No. 07/956,039, now abandoned, and U.S. Pat. Nos. 5,213,225; 5,411,157 and 5,454,476 are incorporated herein by way of reference.

It will be appreciated that the above descriptions are merely illustrative of embodiments of the invention, and that modifications of detail may be made without departing from the scope and principles of the invention.

We claim:

1. A container closure assembly comprising:

a container neck comprising a first screw thread, a radially projecting bead located below said first screw thread , and one or more ratchet projections located below said radially projecting bead;

a closure comprising a crown portion and a skirt portion, said skirt portion being provided with a second screw thread complementary to said first screw thread for securing said closure on said container neck;

a tamper evident ring joined to said closure skirt portion by severable connections and comprising a generally annular collar for said neck, an opening or recess formed in said collar, wherein said opening or recess is bounded by an edge formed in said collar, wherein a portion of said edge is attached to a tab, said tab extending from said collar and being inclined radially inwardly and obliquely relative to a central axis of said ring, wherein said opening or recess defines a clearance in said collar to permit said tab to flex relative to said collar in a radially outward direction;

said ratchet projections being configured to allow rotation of said tamper evident ring in a screwing direction on said neck, but to block rotation of said tamper evident ring in an unscrewing direction by abutment with said tab, whereby, when said closure is initially screwed onto said container neck, said tab flexes outwardly to allow said tamper evident ring to pass over said bead without breaking said severable connections, and said tab then rotates past said ratchet projections as said tamper evident ring is rotated in said screwing down direction; and whereby, when said closure is unscrewed from said container neck for the first time, said tab abuts against an underside of said bead and also against said ratchet projections to exert axial and circumferential breaking forces on said tamper evident ring to sever said tamper evident ring from said closure at said severable connections.

2. An assembly according to claim 1, wherein said tab comprises a fixed end attached to said collar and a free end, wherein said tab is supported at its fixed end by a hinge joint.

3. An assembly according to claim 2, wherein said tab is formed integrally with said collar, and said hinge joint comprises a pliant material.

4. An assembly according to claim 1, wherein said tab comprises a fixed end attached to said collar and a free end, wherein each said tab tapers in thickness towards its free end.

5. An assembly according to claim 4, wherein said tab comprises a fixed end attached to said collar and a free end, wherein said tab is supported at its fixed end by a hinge joint.

6. An assembly according to claim 5, wherein said tab is formed integrally with said collar, and said hinge joint comprises a pliant material.

7. An assembly according to claim 1, further comprising a locking mechanism for positively retaining said closure in a predetermined closed orientation on said neck.

8. An assembly according to claim 7, wherein said tab comprises a fixed end attached to said collar and a free end, wherein said tab tapers in thickness towards its free end.

9. An assembly according to claim 7, wherein said tab comprises a fixed end attached to said collar and a free end, wherein said tab is supported at its fixed end by a hinge joint.

10. An assembly according to claim 9, wherein said tab is formed integrally with said collar, and said hinge joint comprises a pliant material.

11. An assembly according to claim 1, wherein said ratchet projection on said neck is joined to said bead, and extends from the underside thereof.

12. An assembly according to claim 11 further comprising a locking mechanism for positively retaining said closure in a predetermined closed orientation on said neck.

13. An assembly according to claim 11, wherein said tab comprises a fixed end attached to said collar and a free end, wherein said tab tapers in thickness towards its free end.

14. An assembly according to claim 11, wherein said tab comprises a fixed end attached to said collar and a free end, wherein said tab is supported at its fixed end by a hinge joint.

15. An assembly according to claim 14, wherein said tab is formed integrally with said collar, and said hinge joint comprises a pliant material.

16. An assembly according to claim 1, wherein at least one of said ratchet projections comprises a ramp profile, having a circumferentially or arcuately extending ramp surface and an abutment surface.

17. An assembly according to claim 16 further comprising a locking mechanism for positively retaining said closure in a predetermined closed orientation on said neck.

18. An assembly according to claim 16, wherein said tab comprises a fixed end attached to said collar and a free end, wherein said tab tapers in thickness towards its free end.

19. An assembly according to claim 16, wherein said tab comprises a fixed end attached to said collar and a free end, wherein said tab is supported at its fixed end by a hinge joint.

20. An assembly according to claim 19, wherein said tab is formed integrally with said collar, and said hinge joint comprises a pliant material.

21. An assembly according to claim 1 or 16, wherein said ratchet projection on said neck is joined to said bead, and extends from said underside thereof.

22. An assembly according to claim 21 further comprising a locking mechanism for positively retaining said closure in a predetermined closed orientation on said neck.

23. An assembly according to claim 21, wherein said tab comprises a fixed end attached to said collar and a free end, wherein said tab tapers in thickness towards its free end.

24. An assembly according to claim 21, wherein said tab comprises a fixed end attached to said collar and a free end, wherein said tab is supported at its fixed end by a hinge joint.

25. An assembly according to claim 24, wherein said tab is formed integrally with said collar, and said hinge joint comprises a pliant material.

26. A container closure assembly comprising:

a container neck comprising a first screw thread, a radially projecting bead located below said first screw thread, and one or more ratchet projections located below said radially projecting bead;

a closure comprising a crown portion and a skirt portion, said skirt portion being provided with a second screw thread complementary to said first screw thread for securing said closure on said container neck;

a tamper evident ring joined to said closure skirt portion by severable connections and comprising a generally annular collar for said neck, an opening or recess formed in said collar, wherein a portion of an edge of said opening or recess is attached to a tab, said tab extending from said collar and being inclined radially inwardly and obliquely relative to a central axis of said ring, wherein said tab flexes relative to said collar in a radially outward direction;

said ratchet projections being configured to allow rotation of said tamper evident ring in a screwing direction on said neck, but to block rotation of said tamper evident ring in an unscrewing direction by abutment with said tab, whereby, when said closure is initially screwed onto said container neck, said tab flexes outwardly to allow said tamper evident ring to pass over said bead without breaking said severable connections, and said tab then rotates past said ratchet projections as said tamper evident ring is rotated in said screwing down direction; and whereby, when said closure is unscrewed from said container neck for the first time, said tab abuts against an underside of said bead and also against said ratchet projections to exert axial and circumferential breaking forces on said tamper evident ring to sever said tamper evident ring from said closure at said severable connections.

27. An assembly according to claim 26, wherein said tab comprises a fixed end attached to said collar and a free end, wherein said tab is supported at its fixed end by a hinge joint.

28. An assembly according to claim 27, wherein said tab is formed integrally with said collar, and said hinge joint comprises a pliant material.

29. An assembly according to claim 26, wherein said tab comprises a fixed end attached to said collar and a free end, wherein said tab tapers in thickness towards its free end.

30. An assembly according to claim 29, wherein said tab comprises a fixed end attached to said collar and a free end, wherein said tab is supported at its fixed end by a hinge joint.

31. An assembly according to claim 30, wherein said tab is formed integrally with said collar, and said hinge joint comprises a pliant material.

32. An assembly according to claim 26, further comprising a locking mechanism for positively retaining said closure in a predetermined closed orientation on said neck.

33. An assembly according to claim 32, wherein said tab comprises a fixed end attached to said collar and a free end, wherein said tab tapers in thickness towards its free end.

34. An assembly according to claim 32, wherein said tab comprises a fixed end attached to said collar and a free end, wherein said tab is supported at its fixed end by a hinge joint.

35. An assembly according to claim 34, wherein said tab is formed integrally with said collar, and said hinge joint comprises a pliant material.

36. An assembly according to claim 26, wherein at least one of said ratchet projections comprises a ramp profile, having a circumferentially or arcuately extending ramp surface and an abutment surface.

37. An assembly according to claim 36 further comprising a locking mechanism for positively retaining said closure in a predetermined closed orientation on said neck.

38. An assembly according to claim 36, wherein said tab comprises a fixed end attached to said collar and a free end, wherein said tab tapers in thickness towards its free end.

39. An assembly according to claim 36, wherein said tab comprises a fixed end attached to said collar and a free end, wherein said tab is supported at its fixed end by a hinge joint.

40. An assembly according to claim 39, wherein said tab is formed integrally with said collar, and said hinge joint comprises a pliant material.

* * * * *

UNITED STATES PATENT AND TRADEMARK OFFICE

CERTIFICATE OF CORRECTION

PATENT NO. : 5,819,965
DATED : October 13, 1998
INVENTOR(S) : Witney M. King et al.

It is certified that error appears in the above-identified patent and that said Letters Patent is hereby corrected as shown below:

Title page,
Item [73], Assignee, please change "Herts, England" to -- Hertfordshire, UK --.
Item [63], Related U.S. Application Data, immediately after "abandoned", please insert -- , which is a 35 U.S.C. § 371 filing of PCT/GB93/02341, filed on Nov. 15, 1993 --.

Signed and Sealed this

Twenty-eighth Day of December, 2004

JON W. DUDAS
*Director of the United States Patent and Trademark Office*